United States Patent [19]

Freedman et al.

[11] 3,935,608

[45] Feb. 3, 1976

[54] ARTICLE OF CLOTHING

[76] Inventors: Raymonde Freedman, 76 Southover, Woodside Park, London, N.12; Alfred William Teale, 69 Foundling Court, Brunswick Centre, London, W.C.1, both of England

[22] Filed: Jan. 2, 1974

[21] Appl. No.: 430,039

[30] Foreign Application Priority Data

Apr. 3, 1973 United Kingdom ..... 15941/73

[52] U.S. Cl. ..... 9/319; 9/335

[51] Int. Cl.² ..... B63C 9/08

[58] Field of Search ..... 9/343, 340, 316, 317, 318, 9/335, 334, 319

[56] References Cited

UNITED STATES PATENTS

| | | | |
|---|---|---|---|
| 1,367,225 | 2/1921 | Barker | 9/318 |
| 2,463,641 | 3/1949 | Podell | 9/343 |
| 2,703,891 | 3/1955 | Mayer | 9/340 X |
| 2,753,574 | 7/1956 | Wolshin | 9/316 |
| 3,032,788 | 5/1962 | Lowther | 9/319 |
| 3,130,424 | 4/1964 | Santangelo | 9/335 X |
| 3,134,993 | 6/1964 | McCoy | 9/335 X |

*Primary Examiner*—Trygve M. Blix
*Assistant Examiner*—Gregory W. O'Connor
*Attorney, Agent, or Firm*—Robert E. Burns; Emmanuel J. Lobato; Bruce L. Adams

[57] ABSTRACT

An article of clothing having a pocket portion containing an inflatable envelope, and a compressed fluid container for inflating the envelope whereby, upon inflation, the envelope is forced out of the pocket portion, the article of clothing being particularly suitable during times of emergency in the water when a wearer of the clothing enters the water and requires an immediate additional buoyancy aid.

7 Claims, 3 Drawing Figures

ARTICLE OF CLOTHING

The present invention relates to articles of clothing having an envelope which is inflatable by means of fluid held in a compressed fluid cannister container and in particular relates to sailing and boating garments, swimwear, belts and other like leisure wear having an inflatable envelope carried in a pocket portion of the garment.

The article of clothing of the present invention has particular application during times of emergency in the water when a wearer of the clothing enters the water and finds difficulty in swimming or staying on the surface. Furthermore, the appearance of the article of clothing is not hindered since the inflatable envelope is disguised within a pocket in the belt line of the clothing.

According to the present invention there is provided an article of clothing having a pocket portion containing an inflatable envelope, and a compressed fluid container for inflating the envelope whereby, upon inflation, the envelope is forced out of the pocket portion.

Preferably the compressed fluid container is locatable within the inflatable envelope.

The inflatable envelope may have a removable seal member formed therein, the compressed fluid container being insertable through the seal member for location within the inflatable envelope.

Preferably the seal member leads to a perforated pocket within the inflatable envelope, the compressed fluid container being locatable within the perforated pocket.

Alternatively the compressed fluid container forms at least a part of a buckle of the clothing and the envelope is permanently attached to the buckle by gas conduits and/or cords.

The compressed fluid container may be activated by contact with water.

Furthermore and preferably the inflatable envelope is annular or U-shaped although any shape may be used.

Particular embodiments of the present invention will now be described by way of example with reference to the accompanying drawings in which.

Figure 1:
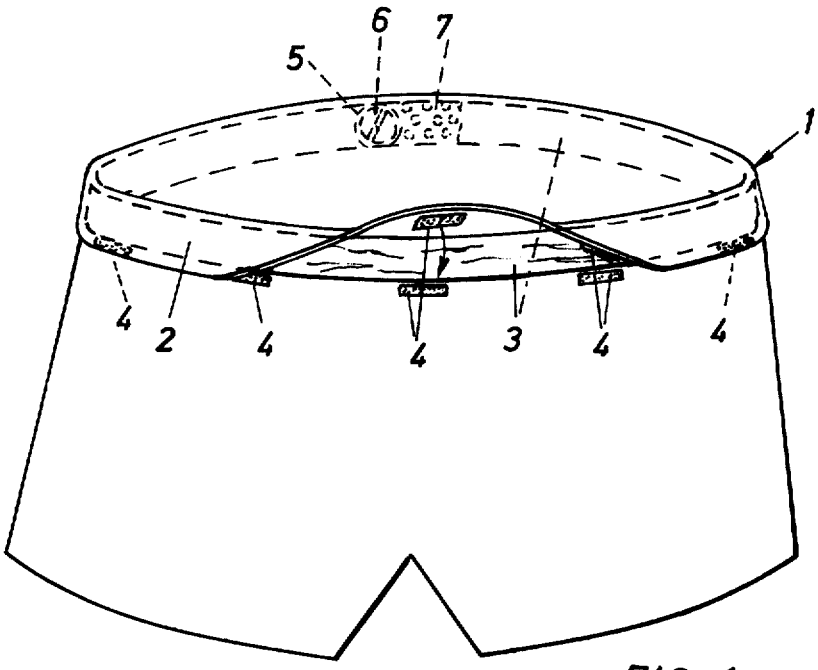
FIG. 1 is a perspective view of a pair of swimming trunks.

With reference to FIG. 1, a belt line 1 in the swimming trunks is formed with a pocket 2 which contains a folded inflatable annular envelope 3 of rubber, polythene or like material. A cannister or cylinder containing compressed carbondioxide is held within the envelope 3, carbondioxide gas passing into the envelope for inflation thereof when the cannister is activated.

The pocket 2 of the trunks may be closed by material marketed and sold under the Registered Trade Mark "Velcro" 4. However, any suitable fastening means such as press studs, which may be unfastened when the envelope contained within the pocket expands during inflation, may be used.

Figure 2:
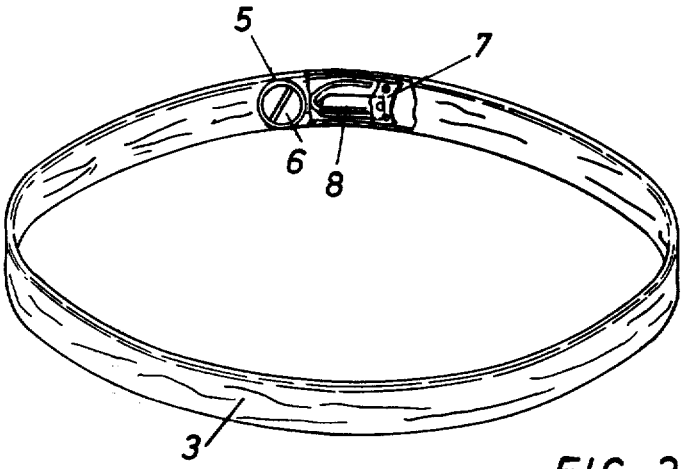
FIG. 2 is a perspective view of an inflatable envelope for use in the trunks of FIG. 1.

With reference now to FIG. 2, the flexible inflatable envelope 3 has an annular insert 5 of plastics material which is internally threaded to receive a screw 6 also preferably of plastics material. The screw 6, when screwed into the insert 5, forms an effective air and water-tight seal.

A perforated, flexible pocket 7, extends from the inset 5 within the envelope 3 and is used to hold the compressed carbondioxide cannister 8.

In use, a simple emergency lever or like means is operated by the wearer grasping the lever and cannister through the envelope material to activate the cannister 8 so that the envelope 3 is inflated thereby forcing itself out of the pocket 2. An inflated annular ring is thus created around the bather and assists the buoyancy of the bather.

After use, the enelope 3 can be deflated by simply unscrewing the screw 5 from its insert 4. The cannister 8 can then be removed from the perforted pocket 7 and replaced by an unused cannister in readiness for further use. The inflatable envelope 3 is then folded and positioned on the belt line 1 of the swimming trunks before the pocket is closed by the "Velcro " strip with the envelope 3 enclosed therein.

Figure 3:
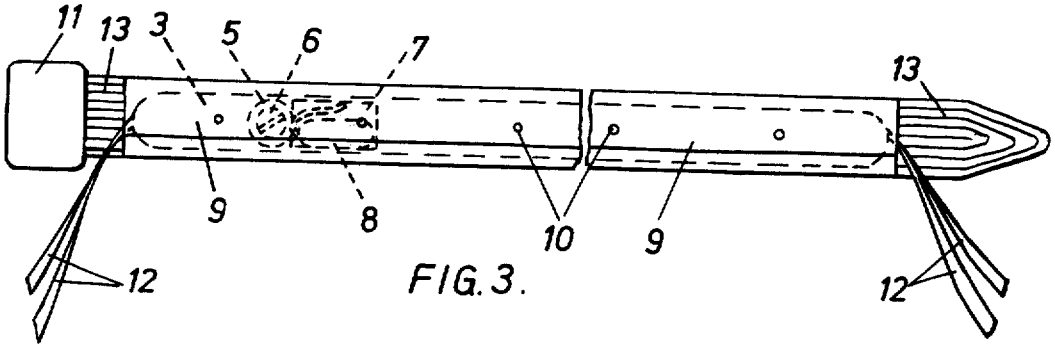
FIG. 3 illustrates a belt having an inflatable envelope.

FIG. 3 illustrates a belt having a flap portion 9 which faces away from a wearer of the belt. This flap portion 9, when closed by means of press studs 10 or other suitable means, forms the pocket 2 of the belt.

A buckle 11 or other catch arrangement is held on one or both ends of the belt. The inflatable envelope 3, held inside the pocket 2 of the belt, has end tapes 12 by means of which the inflated envelope is held around the wearer. These end tapes 12 are tied conveniently behind the buckle 11. A stretch nylon portion 13 enables the belt to be worn by wearers of different measurements.

The cannister 8 is held within the envelope 3 in a similar manner as hereinbefore described, the screw 6 and inset 5 permitting simple replacement of a redundant cannister 8.

The belt is particularly useful since it can be worn with all types of belted or even non-belted clothes.

An alternative embodiment of the present invention is a belt having a pocket formed therein with a cannister 8 shaped as part of a buckle of the belt. The inflatable envelope is held in the pocket of the belt and linked to the cannister by gas conduits. Such a belt may be conveniently used with many other articles of clothing, such as sailing wear, when the wearer is likely to inadvertently enter the water.

The inflatable envelope need not be annular or U-shaped but may be half-round, rectangular, spherical or other shape when folded or inflated.

Furthermore, any form of compressed gas container may be used, such as a cannister which is activated simply by contact with water. Such cannisters normally have a springloaded plunger which is released by a dissolved pellet to pierce the cannister.

We claim:

1. An article for wear as an inflatable safety device comprising, means for defining a pocket member wearable as an article of wear, an inflatable envelope contained uninflated within the pocket member, a compressed fluid container wholly within the inflatable envelope, means on said container for actuation to release the fluid therefrom thereby inflating the envelope and causing the inflated envelope to be forced out of the pocket member and to separate completely therefrom, releasable means on said pocket member for allowing the inflated envelope to separate from said pocket member upon inflation thereof, and wherein in use said envelope encircles the body of a wearer, whereby on release it travels up under the arms of the wearer.

2. An article for wear as an inflatable safety device according to claim 1, in which said envelope is annular.

3. An article for wear as an inflatable safety device according to claim 1, including means to fasten the ends of said envelope to make it annular.

4. An article for wear as an inflatable safety device according to claim 1, including means defining a sealable opening in said envelope for replacing said fluid container therein.

5. An article for wear as an inflatable safety device according to claim 1, in which said article of wear defining said pocket member comprises a belt.

6. An article for wear as an inflatable safety device according to claim 1, in which said article of wear comprises a swimsuit.

7. An article for wear as an inflatable safety device according to claim 1, in which said means on said container for actuation comprises a lever.

* * * * *